US008632279B2

(12) United States Patent
Taylor

(10) Patent No.: US 8,632,279 B2
(45) Date of Patent: Jan. 21, 2014

(54) SPLICE FOR A SOIL REINFORCING ELEMENT OR CONNECTOR

(75) Inventor: Thomas P. Taylor, Colleyville, TX (US)

(73) Assignee: T & B Structural Systems LLC

( * ) Notice: Subject to any disclaimer, the term of this patent is extended or adjusted under 35 U.S.C. 154(b) by 201 days.

(21) Appl. No.: 12/887,907

(22) Filed: Sep. 22, 2010

(65) Prior Publication Data

US 2011/0170960 A1 Jul. 14, 2011

Related U.S. Application Data

(63) Continuation-in-part of application No. 12/684,479, filed on Jan. 8, 2010, now Pat. No. 8,393,829.

(51) Int. Cl.
*E02D 29/02* (2006.01)

(52) U.S. Cl.
USPC ..... 405/262; 405/284; 405/286

(58) Field of Classification Search
USPC ..... 405/262, 272, 284, 286, 287, 302.4; 29/525.01, 525.02, 525.11; 411/522, 411/530; 52/378–383
See application file for complete search history.

(56) References Cited

U.S. PATENT DOCUMENTS

| | | | |
|---|---|---|---|
| 991,041 | A | 5/1911 | Toennes |
| RE13,299 | E | 10/1911 | Denison |
| 1,144,143 | A | 6/1915 | McGillivray |
| 1,813,912 | A | 7/1931 | Clark |
| 1,959,816 | A | 5/1934 | Crum |
| 1,992,785 | A | 2/1935 | Steuer |
| 2,137,153 | A | 11/1938 | Brozek |
| 2,208,589 | A | 7/1940 | Leemhuis |
| 2,275,933 | A | 3/1942 | Werner |
| 2,316,712 | A | 4/1943 | Prince |
| 2,327,640 | A | 8/1943 | Hendry |
| 2,552,712 | A | 5/1951 | Ellis |
| 2,703,963 | A | 3/1955 | Gutierrez |
| 2,881,614 | A | 4/1959 | Preininger |
| 3,597,928 | A | 8/1971 | Pilaar |
| 3,680,748 | A | 8/1972 | Brunhuber |

(Continued)

FOREIGN PATENT DOCUMENTS

| | | |
|---|---|---|
| EP | 427221 A | 5/1991 |
| EP | 0679768 | 2/1995 |

(Continued)

OTHER PUBLICATIONS

International Application No. PCT/US08/69011—International Search Report and Written Opinion dated Oct. 10, 2008.

(Continued)

*Primary Examiner* — Sean Andrish
(74) *Attorney, Agent, or Firm* — Edmonds & Nolte, PC

(57) ABSTRACT

A system and method of constructing a mechanically stabilized earth (MSE) structure. A wire facing is composed of horizontal and vertical elements. A soil reinforcing element has a plurality of transverse wires coupled to at least two longitudinal wires having lead ends that upwardly-extend. A bearing plate includes one or more longitudinal protrusions configured to receive and seat the upwardly extending lead ends and couple the soil reinforcing element to the wire facing, and in particular to the vertical element. Multiple systems can be characterized as lifts and erected one atop the other to a desired MSE structure height.

12 Claims, 2 Drawing Sheets

(56) References Cited

U.S. PATENT DOCUMENTS

| | | | |
|---|---|---|---|
| 3,998,022 | A | 12/1976 | Muse |
| 4,075,924 | A | 2/1978 | McSherry |
| 4,116,010 | A | 9/1978 | Vidal |
| 4,117,686 | A | 10/1978 | Hilfiker |
| 4,123,881 | A | 11/1978 | Muse |
| 4,134,241 | A | 1/1979 | Walton |
| 4,286,895 | A | 9/1981 | Poli |
| 4,324,508 | A | 4/1982 | Hilfiker |
| 4,329,089 | A | 5/1982 | Hilfiker |
| 4,341,491 | A | 7/1982 | Neumann |
| 4,343,572 | A | 8/1982 | Hilfiker |
| 4,391,557 | A | 7/1983 | Hilfiker |
| 4,411,255 | A | 10/1983 | Lee |
| 4,470,728 | A | 9/1984 | Broadbent |
| 4,505,621 | A | 3/1985 | Hilfiker |
| 4,514,113 | A | 4/1985 | Neumann |
| 4,616,959 | A | 10/1986 | Hilfiker |
| 4,643,618 | A | 2/1987 | Hilfiker |
| 4,651,975 | A | 3/1987 | Howell |
| 4,653,962 | A | 3/1987 | McKittrick |
| 4,661,023 | A | 4/1987 | Hilfiker |
| 4,664,552 | A | 5/1987 | Schaaf |
| 4,710,062 | A | 12/1987 | Vidal |
| 4,725,170 | A | 2/1988 | Davis |
| 4,834,584 | A | 5/1989 | Hilfiker |
| 4,856,939 | A | 8/1989 | Hilfiker |
| 4,914,876 | A | 4/1990 | Forsberg |
| 4,920,712 | A | 5/1990 | Dean, Jr. |
| 4,929,125 | A | 5/1990 | Hilfiker |
| 4,952,098 | A | 8/1990 | Grayson |
| 4,961,673 | A | 10/1990 | Pagano |
| 4,968,186 | A | 11/1990 | Ogorchock |
| 4,993,879 | A | 2/1991 | Hilfiker |
| 5,044,833 | A | 9/1991 | Wilfiker |
| 5,066,169 | A | 11/1991 | Gavin |
| 5,076,735 | A | 12/1991 | Hilfiker |
| 5,139,369 | A | 8/1992 | Jaecklin |
| 5,156,496 | A | 10/1992 | Vidal |
| 5,190,413 | A | 3/1993 | Carey |
| 5,207,038 | A | 5/1993 | Negri |
| RE34,314 | E | 7/1993 | Forsberg |
| 5,257,880 | A | 11/1993 | Janopaul |
| 5,259,704 | A | 11/1993 | Orgorchock |
| 5,417,523 | A | 5/1995 | Scales |
| 5,451,120 | A | 9/1995 | Martinez-Gonzalez |
| 5,456,554 | A | 10/1995 | Barrett |
| 5,474,405 | A | 12/1995 | Anderson |
| D366,191 | S | 1/1996 | Gay |
| 5,484,235 | A | 1/1996 | Hilfiker |
| 5,487,623 | A | 1/1996 | Anderson |
| 5,494,379 | A | 2/1996 | Anderson |
| 5,507,599 | A | 4/1996 | Anderson |
| 5,522,682 | A | 6/1996 | Egan |
| 5,525,014 | A | 6/1996 | Brown |
| 5,531,547 | A | 7/1996 | Shimada |
| 5,533,839 | A | 7/1996 | Shimada |
| 5,582,492 | A | 12/1996 | Doyle |
| 5,622,455 | A | 4/1997 | Anderson |
| 5,702,208 | A | 12/1997 | Hilfiker |
| 5,722,799 | A | 3/1998 | Hilfiker |
| 5,730,559 | A | 3/1998 | Anderson |
| 5,733,072 | A | 3/1998 | Hilfiker |
| D393,989 | S | 5/1998 | Groves |
| 5,749,680 | A | 5/1998 | Hilfiker |
| 5,797,706 | A | 8/1998 | Segrestin |
| 5,807,030 | A | 9/1998 | Anderson |
| 5,820,305 | A | 10/1998 | Taylor |
| 5,947,643 | A | 9/1999 | Anderson |
| 5,951,209 | A | 9/1999 | Anderson |
| 5,971,699 | A | 10/1999 | Winski |
| 5,975,809 | A | 11/1999 | Taylor |
| 5,975,810 | A | 11/1999 | Taylor |
| 6,024,516 | A | 2/2000 | Taylor |
| 6,050,748 | A | 4/2000 | Anderson |
| 6,079,908 | A | 6/2000 | Anderson |
| 6,086,288 | A | 7/2000 | Ruel |
| D433,291 | S | 11/2000 | Shamoon |
| 6,186,703 | B1 | 2/2001 | Shaw |
| 6,336,773 | B1 | 1/2002 | Anderson |
| 6,345,934 | B1 | 2/2002 | Jailloux |
| 6,357,970 | B1 | 3/2002 | Hilfiker |
| 6,517,293 | B2 | 2/2003 | Taylor |
| 6,595,726 | B1 | 7/2003 | Egan |
| 6,793,436 | B1 | 9/2004 | Ruel |
| 6,802,675 | B2 | 10/2004 | Timmons |
| 6,857,823 | B1 | 2/2005 | Hilfiker |
| 6,865,857 | B1 * | 3/2005 | Adell Argiles ..... 52/703 |
| 6,939,087 | B2 | 9/2005 | Ruel |
| 7,033,118 | B2 | 4/2006 | Hilfiker |
| 7,073,983 | B2 | 7/2006 | Hilfiker |
| 7,270,502 | B2 | 9/2007 | Brown |
| 7,281,882 | B2 | 10/2007 | Hilfiker |
| 7,399,144 | B2 | 7/2008 | Kallen |
| D599,630 | S | 9/2009 | Taylor |
| 7,722,296 | B1 | 5/2010 | Taylor |
| 7,891,912 | B2 | 2/2011 | Taylor |
| 7,972,086 | B2 | 7/2011 | Taylor |
| 7,980,790 | B2 | 7/2011 | Taylor |
| 8,079,782 | B1 | 12/2011 | Hilfiker |
| 2002/0044840 | A1 | 4/2002 | Taylor |
| 2002/0067959 | A1 | 6/2002 | Thornton |
| 2003/0223825 | A1 | 12/2003 | Timmons |
| 2004/0018061 | A1 | 1/2004 | Jansson |
| 2004/0161306 | A1 | 8/2004 | Ruel |
| 2004/0179902 | A1 | 9/2004 | Ruel |
| 2005/0111921 | A1 | 5/2005 | Taylor |
| 2005/0163574 | A1 | 7/2005 | Hilfiker |
| 2005/0271478 | A1 | 12/2005 | Ferraiolo |
| 2005/0286981 | A1 | 12/2005 | Robertson |
| 2006/0204342 | A1 | 9/2006 | Hilfiker |
| 2006/0239783 | A1 | 10/2006 | Kallen |
| 2007/0014638 | A1 | 1/2007 | Brown |
| 2009/0016825 | A1 | 1/2009 | Taylor |
| 2009/0067933 | A1 | 3/2009 | Taylor |
| 2009/0285639 | A1 | 11/2009 | Taylor |
| 2009/0304456 | A1 | 12/2009 | Taylor |
| 2010/0247248 | A1 | 9/2010 | Taylor |
| 2011/0170957 | A1 | 7/2011 | Taylor |
| 2011/0170958 | A1 | 7/2011 | Taylor |
| 2011/0170960 | A1 | 7/2011 | Taylor |
| 2011/0229274 | A1 | 9/2011 | Taylor |
| 2011/0311317 | A1 | 12/2011 | Taylor |
| 2011/0311318 | A1 | 12/2011 | Taylor |

FOREIGN PATENT DOCUMENTS

| | | |
|---|---|---|
| FR | 530097 | 9/1921 |
| FR | 1006087 | 1/1952 |
| JP | 3114014 | 6/1991 |
| JP | 08209703 | 8/1996 |
| JP | 08326074 | 12/1996 |
| KR | 1020080058697 | 6/2008 |
| KR | 1020100027693 | 3/2010 |
| WO | WO9413890 | 6/1994 |
| WO | WO2009009369 | 1/2009 |
| WO | WO2009140576 | 11/2009 |
| WO | WO2010082940 | 7/2010 |
| WO | WO2011084983 | 7/2011 |
| WO | WO2011084986 | 7/2011 |
| WO | WO2011084989 | 7/2011 |
| WO | WO2011127349 | 10/2011 |
| WO | WO2011059807 | 12/2011 |
| WO | WO2011159808 | 12/2011 |

OTHER PUBLICATIONS

International Application No. PCT/US09/031494—International Search Report and Written Opinion dated Mar. 13, 2009.

International Application No. PCT/US09/44099—International Search Report and Written Opinion dated Aug. 12, 2009.

International Application No. PCT/US08/069011—International Preliminary Report on Patentability dated Jan. 21, 2010.

International Application No. PCT/US10/036991—International Search Report and Written Opinion dated Aug. 2, 2010.

(56) References Cited

OTHER PUBLICATIONS

International Application No. PCT/US09/44099—International Preliminary Report on Patentability dated Nov. 25, 2010.
International Application No. PCT/US2010/036991—International Preliminary Examination Reported mailed Jul. 14, 2011.
International Application No. PCT/US09/0031494—International Preliminary Report on Patentability dated Jul. 19, 2011.
International Application No. PCT/US2010/036991—Corrected International Preliminary Examination Report mailed Aug. 15, 2011.
International Application No. PCT/US2011/031688—International Search Report and Written Opinion dated Nov. 30, 2011.
International Application No. PCT/US2011/040540—International Search Report and Written Opinion dated Feb. 17, 2012.
International Application No. PCT/US2011/040543—International Search Report and Written Opinion dated Feb. 21, 2012.
International Application No. PCT/US2011/040541—International Search Report and Written Opinion dated Feb. 27, 2012.
Webster's tenth edition, "Collegiate Dictionary", p. 423; 1998.

* cited by examiner

SPLICE FOR A SOIL REINFORCING ELEMENT OR CONNECTOR

CROSS-REFERENCE TO RELATED APPLICATIONS

The present application is a continuation-in-part of co-pending U.S. patent application Ser. No. 12/684,479, entitled "Wave Anchor Soil Reinforcing Connector and Method," which was filed on Jan. 8, 2010, the contents of which are incorporated herein by reference in their entirety.

BACKGROUND OF THE DISCLOSURE

Retaining wall structures that use horizontally positioned soil inclusions to reinforce an earth mass in combination with a facing element are referred to as Mechanically Stabilized Earth (MSE) structures. MSE structures can be used for various applications including retaining walls, bridge abutments, dams, seawalls, and dikes. Basic MSE technology involves a repetitive process by which layers of backfill and several horizontally placed soil reinforcing elements are sequentially positioned one atop the other until a desired height of the earthen structure is achieved.

Illustrated in FIG. 1 is a typical soil reinforcing element 100 that can be used in the construction of an MSE structure. The soil reinforcing element 100 generally includes a welded wire grid having a pair of longitudinal wires 102 that are disposed substantially parallel to each other. The longitudinal wires 102 are joined to a plurality of transverse wires 104 in a generally perpendicular fashion by welds or other attachment means at their intersections, thus forming the welded wire grid. In some applications, there may be more that two longitudinal wires 102. The longitudinal wires 102 may have lead ends 106 that generally converge toward one another, as illustrated, and terminate at a wall end 108. In other applications, however, the lead ends 106 do not converge, but instead terminate substantially parallel to one another. Backfill material and a plurality of soil reinforcing elements 100 are then combined and compacted sequentially to form a solid earthen structure taking the form of a standing earthen wall.

The wall end 108 of each soil reinforcing element 100 may include several different connective means adapted to connect the soil reinforcing element 100 to a substantially vertical facing 110, such as a wire facing, or concrete or steel facings constructed a short distance from the standing earthen wall. Once appropriately secured to the vertical facing 110 and compacted within the backfill, the soil reinforcing element 100 provides tensile strength to the vertical facing 110 that significantly reduces any outward movement and shifting thereof.

The longitudinal wires 102 of the soil reinforcing element 100 may extend several feet into the backfill before terminating at corresponding reinforcing ends 112. Where added amounts of tensile resistance are required, longer soil reinforcing elements 100 are required, thereby disposing the reinforcing ends 112 even deeper into the backfill. Single soil reinforcing elements 100, however, often cannot be manufactured to the lengths required to adequately reinforce the vertical facing 110, nor could such soil reinforcing elements 100 of extended lengths be safely or feasibly transported to job sites.

What is needed, therefore, is a system and method of splicing a soil reinforcing element to extend its length.

SUMMARY OF THE DISCLOSURE

Embodiments of the disclosure may provide a splice for a soil reinforcing element. The splice may include a first wave plate defining one or more first transverse protrusions configured to receive and seat a corresponding number of transverse wires of the soil reinforcing element, and a second wave plate defining one or more second transverse protrusions configured to receive and seat a corresponding number of transverse wires of a grid-strip. The splice may further include a first perforation defined in the first wave plate and a second perforation defined in the second wave plate, and a connective device extensible through the first perforation and the second perforation to couple the first wave plate to the second wave plate, wherein a portion of longitudinal wires of the soil reinforcing element and a portion of longitudinal wires of the grid strip are interposed between the first and second wave plates and are thereby prevented from removal.

Other embodiments of the disclosure may provide a composite soil reinforcing element. The composite soil reinforcing element may include a soil reinforcing element having a first plurality of transverse wires coupled to at least two longitudinal wires, the soil reinforcing element having a wall end and a reinforcing end, a grid-strip having a second plurality of transverse wires coupled to at least two longitudinal wires, the grid-strip having a splicing end, and a splice configured to couple the reinforcing end of the soil reinforcing element to the splicing end of the grid-strip. The splice may include a first wave plate defining one or more first transverse protrusions configured to receive and seat a corresponding number of the first plurality of transverse wires of the soil reinforcing element, and a second wave plate defining one or more second transverse protrusions configured to receive and seat a corresponding number of the second plurality of transverse wires of the grid-strip. The splice for the composite soil reinforcing element may further include a first perforation defined on the first wave plate and a second perforation defined on the second wave plate, and a first connective device extensible through the first perforation and the second perforation to couple the first wave plate to the second wave plate and clamp down on the at least two longitudinal wires of the soil reinforcing element and the at least two longitudinal wires of the grid-strip.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
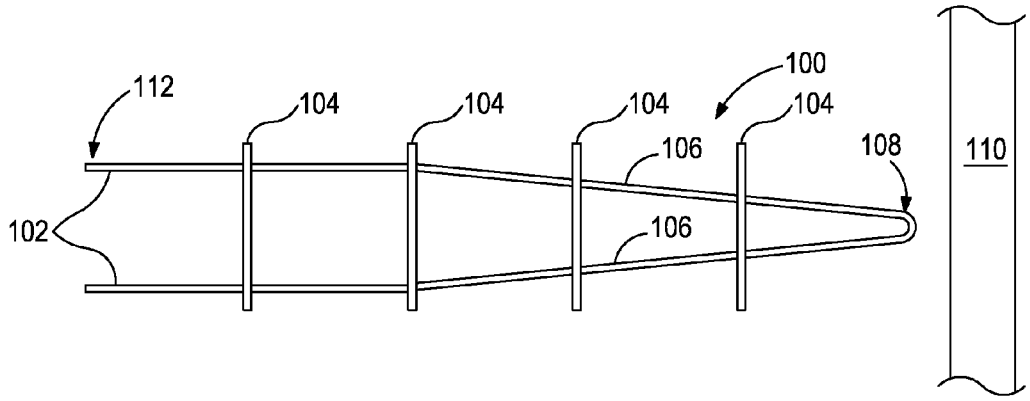
FIG.1 (PRIOR ART)
FIG. 1 is a plan view of a prior art soil reinforcing element.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Figure 2A:
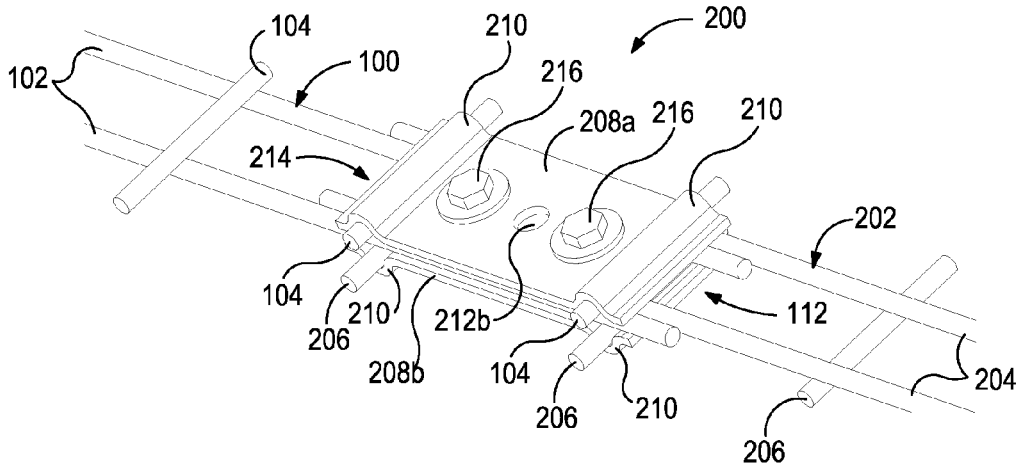
FIG. 2A is an isometric view of an exemplary splice, according to one or more aspects of the present disclosure.
Figure 2B:
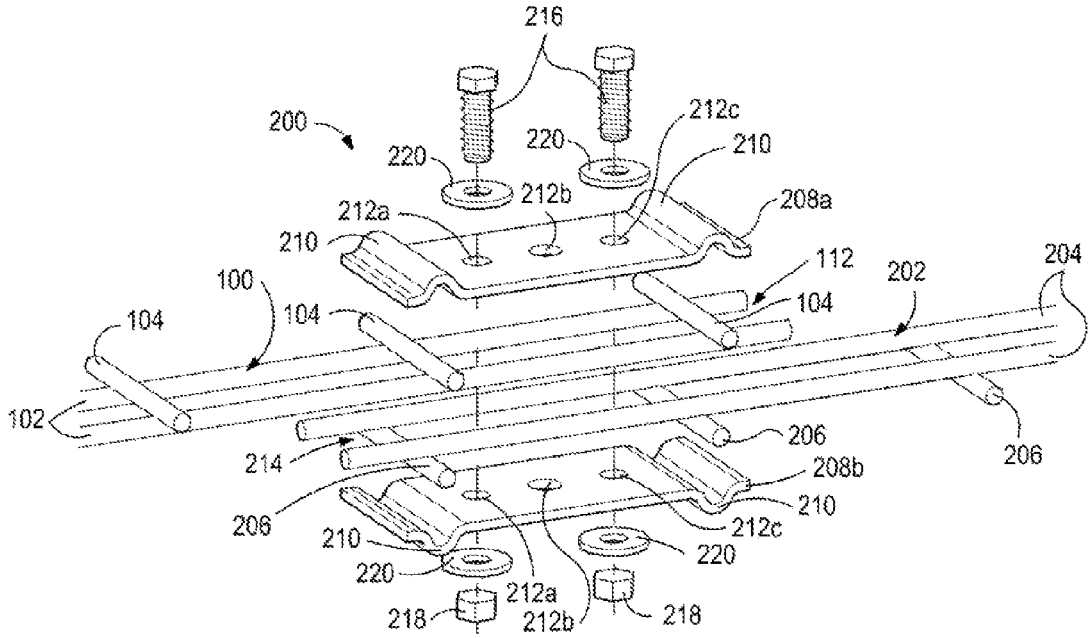
FIG. 2B is an exploded view of the exemplary splice shown in FIG. 2A.

Referring to FIGS. 2A and 2B, depicted is an exemplary joint or splice 200, according to one or more embodiments of the disclosure. The splice 200 may be employed to lengthen the extent of a soil reinforcing element 100, such as the soil reinforcing element 100 generally described above with reference to FIG. 1. Extending the length of the soil reinforcing element 100 may prove advantageous where the soil reinforcing element 100 is not long enough to adequately reinforce a vertical facing 110 (FIG. 1) into adjacent backfill (not shown).

As will be appreciated by those skilled in the art, several designs of soil reinforcing elements 100 having numerous connective devices for attaching the soil reinforcing element 100 to a vertical facing 110 can be used without departing from the scope of the disclosure. For example, the soil reinforcing elements and their various connective devices described in co-owned U.S. Pat. Nos. 6,517,293 and 7,722,296 may be used, the contents of these patents are hereby incorporated by reference to the extent not inconsistent with the present disclosure. Other examples of soil reinforcing elements and their exemplary connective devices that may be appropriately used with the splice 200 disclosed herein include co-pending U.S. patent application Ser. Nos. 12/479,448, 12/756,898, 12/818,011, 12/837,347, and 12/861,632 filed on Jun. 5, 2009, Apr. 8, 2010, Jun. 17, 2010, Jul. 15, 2010, and Aug. 23, 2010, respectively, the contents of each application are also hereby incorporated by reference to the extent not inconsistent with the present disclosure.

To effectively extend the length of a soil reinforcing element 100 into adjacent backfill (not shown), the splice 200 may couple one or more grid-strips 202 to the soil reinforcing element 100. The grid-strip 202 generally extends the length of the soil reinforcing element 100 to the length required for the particular MSE application. Similar to the soil reinforcing element 100, the grid-strip 202 may include at least two longitudinal wires 204 welded or otherwise attached to a plurality of transverse wires 206. Although only two longitudinal wires 204 are illustrated, it will be appreciated that the grid-strip 202 may include any number of longitudinal wires 204 without departing from the scope of the disclosure. Once coupled together, the combination of the soil reinforcing element 100, splice 200, and grid-strip 202 may be characterized or otherwise typified as a single composite soil reinforcing element, for purposes of reinforcing a vertical facing 110 (FIG. 1).

In one or more embodiments, the transverse wires 206 may be equally-spaced or substantially equally-spaced along the length of the longitudinal wires 204 of the grid-strip 202. The spacing between each transverse wire 104 of the soil reinforcing element 100 may be the same or substantially the same as the spacing between each transverse wire 206 of the grid-strip 202. In other embodiments, however, the spacing of the transverse wires 104, 206 may only need to be equally-spaced at or near the reinforcing end 112 of the soil reinforcing element 100 or a splicing end 214 of the grid-strip. In yet other embodiments, the spacing of the transverse wires 104, 206 is irregular along the length of the longitudinal wires 102, 204, respectively.

The splice 200 may include one or more wave plates, such as a first plate 208*a* and a second plate 208*b*. In at least one embodiment, the first and second wave plates 208*a,b* are mirror images of one another. Each wave plate 208*a,b* may include one or more transverse protrusions 210 longitudinally-offset from each other. Each wave plate 208*a,b* may further define one or more plate perforations, such as plate perforations 212*a*, 212*b*, and 212*c*, as shown in FIG. 2B. Each transverse protrusion 210 may be configured to receive and/or seat either a transverse wire 104 from the soil reinforcing element 100 or a transverse wire 206 from the grid-strip 202. Accordingly, in embodiments having two or more transverse protrusions 210, each protrusion 210 may be spaced a predetermined distance from an adjacent protrusion 210 so as to correspond to the equally-spaced transverse wires 104, 206 of either the soil reinforcing element 100 or the grid-strip 202.

In one or more embodiments, one or more transverse wires 104 proximal the reinforcing end 112 of the soil reinforcing element 100 may be coupled to or otherwise seated within the first wave plate 208*a*. Likewise, one or more transverse wires 206 proximal a splicing end 214 of the grid-strip 202 may be coupled to or otherwise seated within the second wave plate 208*b*. As illustrated, the transverse wires 104 of the soil reinforcing element 100 may be disposed above their respective longitudinal wires 102, and the transverse wires 206 of the grid-strip 202 may be disposed below their respective longitudinal wires 204. In other embodiments, however, the relative disposition of the transverse wires 104, 206 may be reversed without departing from the scope of the disclosure. Furthermore, the longitudinal wires 102 of the soil reinforcing element 100 may be laterally-offset from the longitudinal wires 204 of the grid-strip 202.

As the plates 208*a,b* are brought together, and the corresponding perforations 212*a,b,c* of each plate 208*a,b* are axially aligned, the transverse wire(s) 104 of the soil reinforcing element 100 may be seated or otherwise received into the transverse protrusions 210 of the first wave plate 208*a*, and the transverse wire(s) 206 of the grid-strip 202 may be seated or otherwise received into the transverse protrusions 210 of the opposing second wave plate 208*b*. With the corresponding perforations 212*a,b,c* generally aligned, the transverse wires 104 of the soil reinforcing element 100 disposed within corresponding transverse protrusions 210 of the first wave plate 208*a* may be vertically-offset from the transverse wires 206 of the grid-strip 202 disposed within corresponding transverse protrusions 210 of the second wave plate 208*b*.

The splice 200 may be secured by coupling the first wave plate 208*a* to the second wave plate 208*b*. This can be done in several ways. In at least one embodiment, a connective device 216, such as a threaded bolt or similar mechanism, may be extended through one or more of the perforations 212*a,b,c* defined on each plate 208. While only two connective devices 216 are shown in FIGS. 2A and 2B, it will be appreciated that any number connective devices 216 may be employed as corresponding to an equal number of perforations 212 defined in the plates 208*a,b*. In one embodiment, a single connective device 216 may be employed to couple the first wave plate 208*a* to the second wave plate 208*b*.

Each connective device 216 may be secured against removal from the splice 200 by threading a nut 218 or similar device onto its end. Furthermore, one or more washers 220 may also be used to provide a biasing engagement with each plate 208*a,b*. As can be appreciated, the nut 218 and connective device 216 configuration may be substituted with any attachment methods known in the art. For instance, rebar or any other rigid rod may be used and bent over on each end to prevent its removal from the perforations 212*a,b,c*, and thereby provide an adequate coupling mechanism.

Once the splice 200 is made secure, the transverse wires 104, 206 may be prevented from longitudinally escaping the splice 200 since they are seated in respective transverse protrusions 210. Tightening the nut(s) 218 onto the bolt(s) 216, or similar connection device, may clamp down on the longitudinal wires 102, 204 of the soil reinforcing element 100 and grid-strip 202, respectively, thereby preventing the soil reinforcing element 100 and/or grid-strip 202 from translating laterally and thereby escaping the splice 200.

As will be appreciated, any number of splices 200 and grid-strips 202 may be used to extend the length of a single soil reinforcing element 100 and create a composite soil reinforcing element that achieves a desired reinforcing distance from the vertical facing 110 (FIG. 1). For instance, if splicing a first grid-strip 202 to the reinforcing end 112 of the soil reinforcing element 100 does not extend a sufficient distance into the backfill (not shown), a second grid-strip 202 may be spliced to the end of the first grid-strip 202, and so on until the desired distance is achieved. Accordingly, multiple splices 200 and multiple grid-strips 202 may be used to extend the length of a single soil reinforcing element 100.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

I claim:

1. A method of splicing a soil reinforcing element to a grid-strip, comprising:

seating one or more transverse wires proximal a reinforcing end of the soil reinforcing element in one or more first transverse protrusions defined on a first wave plate;

seating one or more transverse wires proximal a splicing end of the grid-strip in one or more second transverse protrusions defined on a second wave plate;

laterally offsetting longitudinal wires of the soil reinforcing element from longitudinal wires of the grid-strip, such that the one or more transverse wires proximal the reinforcing end and the one or more transverse wires proximal the splicing end are spaced apart from each other by the longitudinal wires of the soil reinforcing element and the longitudinal wires of the grid-strip;

aligning a first perforation defined on the first wave plate with a second perforation defined on the second wave plate; and extending a first connective device through the first and second perforations and securing the first connective device from removal and thereby clamping down on the longitudinal wires of the soil reinforcing element and the grid-strip.

2. The method of claim 1, wherein the first connective device is a threaded bolt and securing the first connective device from removal comprises threading a nut to an end of the threaded bolt.

3. The method of claim 1, further comprising:

aligning a third perforation defined on the first wave plate with a fourth perforation defined on the second wave plate; and extending a second connective device through the third and fourth perforations and securing the second connective device from removal.

4. The method of claim 3, wherein the second connective device is a threaded bolt and securing the second connective device from removal comprises threading a nut to an end of the threaded bolt.

5. A composite soil reinforcing element, comprising:

a soil reinforcing element having a first plurality of transverse wires coupled to at least two longitudinal wires, the soil reinforcing element having a wall end and a reinforcing end;

a grid-strip having a second plurality of transverse wires coupled to at least two longitudinal wires, the grid-strip having a splicing end; and a splice coupling the reinforcing end of the soil reinforcing element to the splicing end of the grid-strip, the splice comprising:

a first wave plate defining one or more first transverse protrusions receiving and seating a corresponding number of the first plurality of transverse wires of the soil reinforcing element;

a second wave plate defining one or more second transverse protrusions receiving and seating a corresponding number of the second plurality of transverse wires of the grid-strip;

a first perforation defined on the first wave plate and a second perforation defined on the second wave plate; and a first connective device extending through the first perforation and the second perforation to couple the first wave plate to the second wave plate and clamp down on the at least two longitudinal wires of the soil reinforcing element and the at least two longitudinal wires of the grid-strip, wherein the at least two longitudinal wires of the soil reinforcing element are laterally-offset from the at least two longitudinal wires of the grid-strip such that the first plurality of transverse wires and the second plurality of transverse wires are spaced apart from each other by the at least two longitudinal wires of the soil reinforcing element and the at least two longitudinal wires of the grid-strip.

6. The composite soil reinforcing element of claim 5, wherein the first plurality of transverse wires are equidistantly-spaced along the at least two longitudinal wires of the soil reinforcing element.

7. The composite soil reinforcing element of claim 5, wherein the second plurality of transverse wires are equidistantly-spaced along the at least two longitudinal wires of the grid-strip.

8. The composite soil reinforcing element of claim 5, wherein the first connective device is a threaded bolt.

9. The composite soil reinforcing element of claim 8, wherein the threaded bolt is secured against removal by threading a nut to an end of the threaded bolt.

10. The composite soil reinforcing element of claim 5, wherein the first plurality of transverse wires are irregularly-spaced along the at least two longitudinal wires of the soil reinforcing element.

11. The composite soil reinforcing element of claim 5, wherein the second plurality of transverse wires are irregularly-spaced along the at least two longitudinal wires of the grid-strip.

12. The composite soil reinforcing element of claim 5, further comprising:

a third perforation and a fourth perforation defined on the first wave plate;

a fifth perforation and a sixth perforation defined on the second wave plate, wherein the third and fifth perforations are axially-aligned and the fourth and the sixth perforations are axially-aligned; and a second connective device extensible through the third perforation and the fifth perforation.

* * * * *